US011041327B2

(12) United States Patent
Leyden

(10) Patent No.: US 11,041,327 B2
(45) Date of Patent: Jun. 22, 2021

(54) SECURITY SYSTEM FOR CONTAINER

(71) Applicant: SE-KURE CONTROLS, INC., Franklin Park, IL (US)

(72) Inventor: Roger J. Leyden, Inverness, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 411 days.

(21) Appl. No.: 16/035,139

(22) Filed: Jul. 13, 2018

(65) Prior Publication Data

US 2019/0017296 A1 Jan. 17, 2019

Related U.S. Application Data

(60) Provisional application No. 62/532,466, filed on Jul. 14, 2017.

(51) Int. Cl.
*E05B 73/00* (2006.01)
*C11C 5/00* (2006.01)

(52) U.S. Cl.
CPC ..... *E05B 73/0023* (2013.01); *C11C 5/006* (2013.01); *C11C 5/008* (2013.01); *E05B 73/0052* (2013.01)

(58) Field of Classification Search
CPC . E05B 73/0023; E05B 73/0052; C11C 5/008; C11C 5/006; B65D 50/062; B65D 50/065
USPC ..... 220/359.1
See application file for complete search history.

(56) References Cited

U.S. PATENT DOCUMENTS 3,110,506 A * 11/1963 O'Brien ..... B60P 7/15 410/151
4,227,625 A * 10/1980 Underwood ..... B65D 43/021 215/358
4,744,471 A * 5/1988 Leister ..... E04H 4/10 160/330
2005/0145632 A1* 7/2005 Cocca ..... B65D 25/16 220/495.01
2015/0049470 A1* 2/2015 Kimmel ..... C11C 5/00 362/161

* cited by examiner

*Primary Examiner* — Stephen J Castellano
(74) *Attorney, Agent, or Firm* — Wood, Phillips, Katz, Clark & Mortimer

(57) ABSTRACT

In combination: a) a container having a case bounding a storage space and an access opening bounded by a surface and in communication with the storage space; and b) a security system. The security system has a frame and a force applying structure on the frame. The frame and force applying structure are configured so that with the security system in operative relationship with the container, the security system can be placed selectively in: i) a secured state wherein the force applying structure exerts a compressive force against the access opening surface to thereby prevent at least a part of the security system from being withdrawn from the access opening; and ii) an assembly state wherein the at least part of the security system can be directed into and withdrawn from the access opening.

17 Claims, 4 Drawing Sheets

SECURITY SYSTEM FOR CONTAINER

This application claims the benefit of provisional application No. 62/532,466 filed Jul. 14, 2017.

BACKGROUND OF THE INVENTION

Field of the Invention

This invention relates to containers having an access opening and, more particularly, to a security system that can be directed into or through the access opening into an operative state.

Background Art

Many different security systems have been devised to be placed into an operative state by being directed into or through an access opening on a container. The applicant herein has devised one such system as disclosed in U.S. Pat. No. 9,605,448 (the '448 patent).

The security system in the '448 patent, while not so limited, is usable on jar-type candles, and particularly those with a necked construction. That is, the jar has a case with a larger diameter portion that contains a supply of wax and a concentric, smaller diameter neck, through which access can be gained to a wick embedded in the wax and through which the scents from an aromatic wax ascend to the surrounding atmosphere.

The security system in the '448 patent works effectively in controlling theft of the above-described jar-type containers. Recently, however, a number of high end candles have been developed without a discrete neck. As a result, no shoulder is present at the transition between different diameter regions which might serve as an abutment to confine at least part of a security system within the container.

Accordingly, the security industry has been challenged to devise a security system for candles with at least this different container configuration, which security system might also be used with other types of products with a like configuration.

SUMMARY OF THE INVENTION

In one form, the invention is directed to the combination of: a) a container having a case bounding a storage space and an access opening bounded by a surface and in communication with the storage space; and b) a security system. The security system has a frame and a force applying structure on the frame. The frame and force applying structure are configured so that with the security system in operative relationship with the container, the security system can be placed selectively in: i) a secured state wherein the force applying structure exerts a compressive force against the access opening surface to thereby prevent at least a part of the security system from being withdrawn from the access opening; and ii) an assembly state wherein the at least part of the security system can be directed into the access opening and withdrawn from the access opening.

In one form, the force applying structure has at least one friction component that is pressed against the access opening surface with the security system in the operative relationship with the container and the security system in the secured state.

In one form, the at least one friction component has a peripheral shape extending continuously around an axis.

In one form, the access opening surface extends continuously around an axis. The at least one friction component has a peripheral shape that conforms to at least a part of the access opening surface.

In one form, the force applying structure has first and second pressing components that are moved relative to the frame in different directions as the security system is changed from the assembly state into the secured state.

In one form, the access opening surface extends around an axis and the different directions are different radial directions.

In one form, the at least one friction component is made from a compressible material.

In one form, the access opening surface extends around an axis. The storage space is bounded by a surface extending around the axis. The shape and size of the access opening surface and storage space surface are substantially the same as viewed along the axis.

In one form, the security system further includes a locking assembly that is configured to be selectively changed between: a) a locked state wherein the security system is maintained in the secured state: and b) an unlocked state wherein the security system can be changed from the secured state into the assembly state.

In one form, the container is made from glass.

In one form, the at least one friction component is adhered to the access opening surface.

In one form, an adhesive layer is applied between the at least one friction component and the access opening surface.

In one form, the at least one friction component is releasably adhered to the access opening surface.

In one form, the container has a wax material therein with a plurality of embedded wick lengths that project through the wax. The security system is configured so as not to press the plurality of embedded wick lengths against the wax material with the security system in the operative relationship with the container and the security system in the secured state.

In one form, the invention is provided in further combination with a releasable cap that blocks the access opening with the security system in the operative relationship with the container and the security system in the secured state.

DETAILED DESCRIPTION OF THE PREFERRED EMBODIMENT

Figure 1:
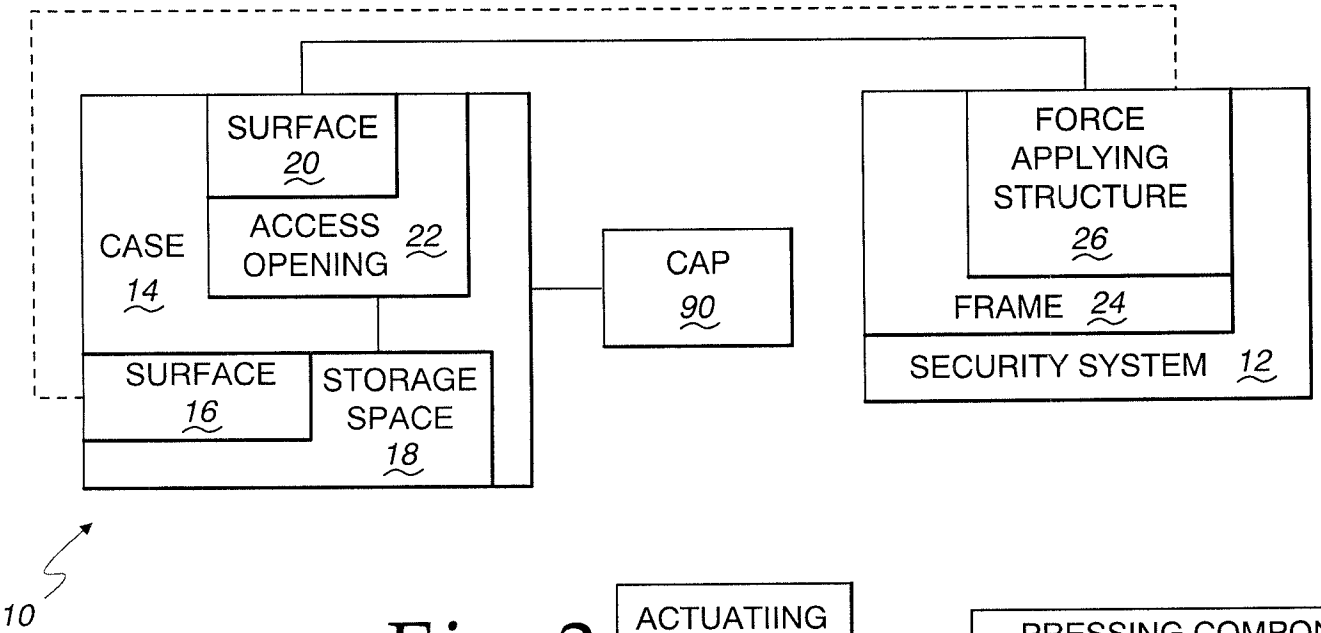
FIG. 1 is a schematic representation of the combination of a container and a security system, according to the invention.

As depicted schematically in FIG. 1, the invention is directed to the combination of a container 10 and a security system 12. The container 10 has a case 14 with a surface 16 surrounding a storage space 18. The case 14 has a surface 20 bounding an access opening 22 that is in communication with the storage space 18.

The container 10, as depicted schematically, is intended to encompass virtually any container shape wherein the contents of the storage space 18 is introduced and/or accessible through the access opening 22. As but one example, and as described in detail below, the container 10 may make up part of a candle product with wax in the storage space 18.

The generic showing is intended to encompass virtually any container shape, including one wherein the surfaces 16, 20 have the same or different shapes and/or size. For example, the surfaces 16, 20 may define a continuous cylindrical shape surrounding an axis with the surface 20, although appearing indistinguishable, being treated as a separate extent thereof at the access location.

The security system 12 consists of a frame 24 and a force applying structure 26 on the frame 24.

The frame 24 and force applying structure 26 are configured so that with the security system 12 in operative relationship with the container 10, the security system 12 can be placed selectively in: a) a secured state wherein the force applying structure 26 exerts a compressive force against the access opening surface 20 to thereby prevent at least a part of the security system 12 from being withdrawn from the access opening 22; and b) and assembly state wherein the at least part of the security system 12 can be directed into the access opening and withdrawn therefrom.

The security system 12 may be as simple as having two components with one being urged away from the other so as to thereby cause a compressive force to be applied against the access opening surface 20 by one of the components. In that event, one of the two components is considered to be the frame 24, with the other making up the force applying structure 26.

As shown in dotted lines in FIG. 1, it is also contemplated that the force applying structure 26 may act against a part of the surface 16 bounding the storage space 18. This could be the case whether or not the surfaces 18, 20 have the same shape and/or diameter.

Figure 2:
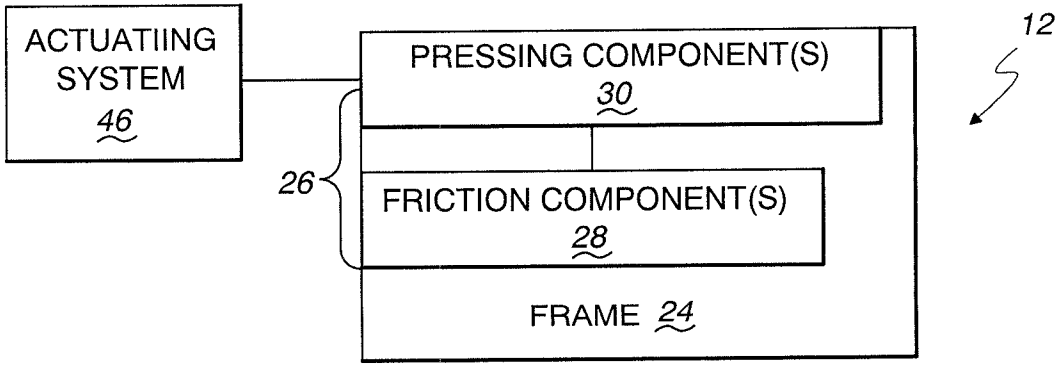
FIG. 2 is a schematic representation of the security system in FIG. 1 and showing additional details thereof.

In one exemplary form, as shown schematically in FIG. 2, the force applying structure 26 consists of at least one friction component 28 that is pressed against the access opening surface 20 with the security system 12 in operative relationship with the container 10 and the security system 12 in its secured state.

The force applying structure 26 further includes at least one pressing component 30 that is moved relative to the frame 24 as the security system is changed from the assembly state into the secured state.

Figure 3:
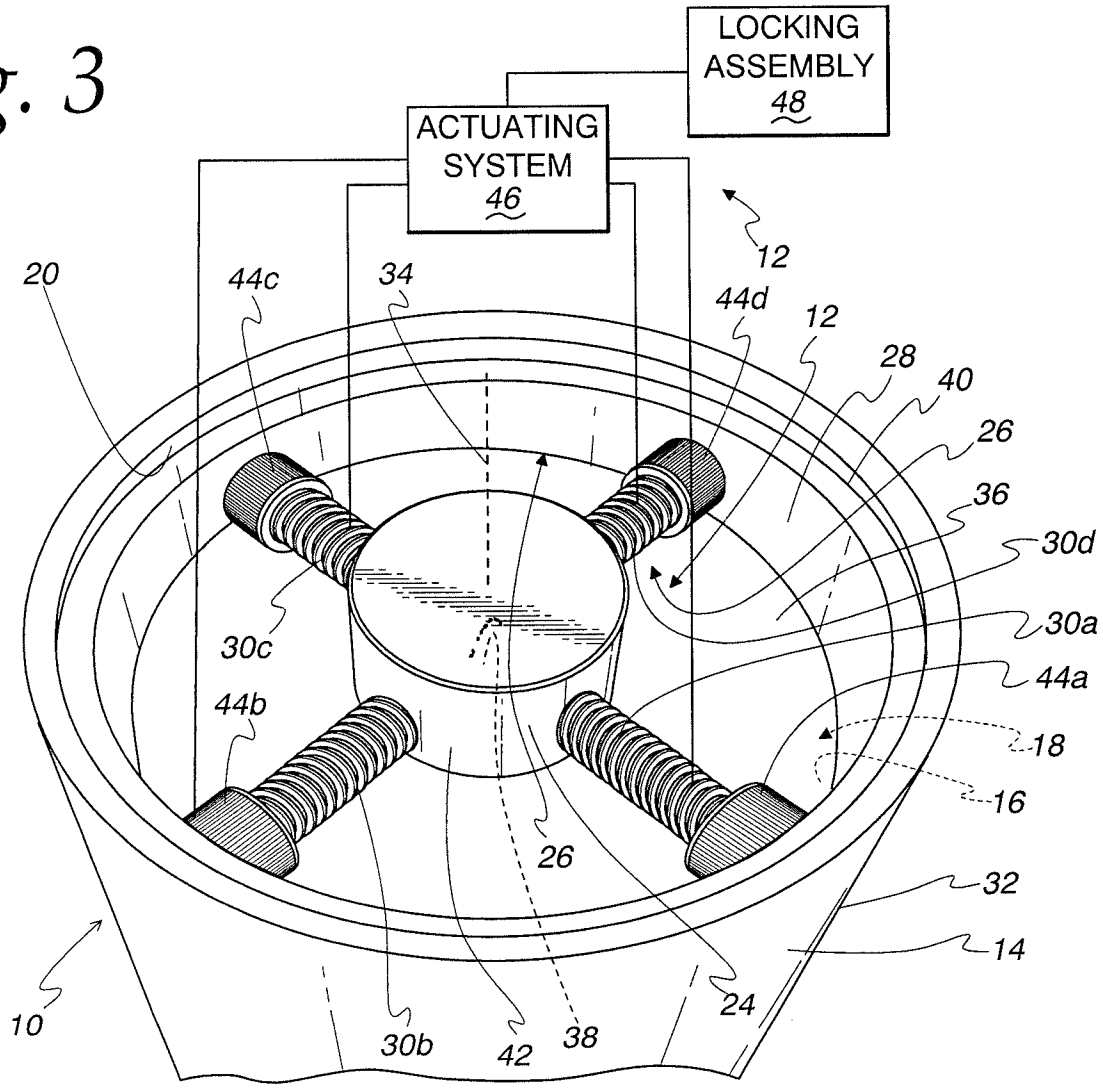
FIG. 3 is a partially schematic, fragmentary, perspective view showing one specific, exemplary form of each of the container and security system, as shown schematically in FIG. 1.

In FIG. 3, one exemplary form of the container 10 is shown in the form of a jar candle. The security system 12 is shown in partially schematic form thereon.

As depicted, the container case 14 has a peripheral wall 32 with a constant cylindrical shape around a central vertical axis 34.

Since there is no clear distinction between the surfaces 16, 20, the surface 16 is considered to be that portion containing a supply of wax 36 with an embedded wick 38. The surface 20 is considered to be that portion above the wax accumulation that can be engaged by the force applying structure 26 on the security system 12.

As depicted, the surface 20 has a cylindrical shape. A single friction component 28 has a peripheral surface/shape 40 that conforms to, or can be conformed to, at least part of the access opening surface 20. The surface 40 has a continuous shape around the axis 34 to conform at least nominally to the full annular extent of the access opening surface 20.

The force applying structure 26 consists of the friction component 28 and, in this case, four pressing components 30*a*, 30*b*, 30*c*, 30*d*. As depicted, the pressing components 30 are threaded into a frame body 42. By turning the pressing components 30 around their respective axes, pressing parts 44*a*, 44*b*, 44*c*, 44*d* thereon are moved selectively towards and away from the axis 34, in the latter case to cause a compressive force to be exerted upon the friction component 28 against the surface 20. The friction component 28 depicted is made from a compressible material, such as rubber, so that under this radial force application, it is positively, frictionally held against the access opening surface 20 thereby to be maintained in a fixed axial position.

In this embodiment, the pressing components 30*a*, 30*c* and 30*b*, 30*d* are extendable radially oppositely relative to the frame body 42 to thereby squeeze the friction component 28 against the access opening surface 20 at diametrically opposite locations.

With the four pressing components 30*a*, 30*b*, 30*c*, 30*d* utilized, the part of the security system 12 within the access opening 22 can be held positively in place without compromising the glass material of the case 14. Of course, glass is not required to be used for the container 10.

The pressing components 30*a*, 30*b*, 30*c*, 30*d* may be individually manipulated. Alternatively, an actuating system, as shown schematically at 46, may be incorporated to simultaneously move multiple, or all, of the pressing components 30*a*, 30*b*, 30*c*, 30*d*. The actuating system 46 is shown incorporated into the schematic representation of the security system 12 in FIG. 2.

There is no specific requirement for the construction of the actuating system as virtually any mechanism that is capable of moving one or more pressing components 30, individually or simultaneously, is contemplated.

For example, one or more ratchet components may be incorporated to maintain progressively advancing positions of the pressing components 30*a*, 30*b*, 30*c*, 30*d*. The pressing components 30*a*, 30*b*, 30*c*, 30*d* might be advanced with or without a special tool, individually or in multiples. A security tool might be used to release the ratchets. Such tool may be controlled to apply a releasing force on a component. Force application may be effected magnetically, individually or in multiples, or through any other appropriate means/mechanism.

As shown schematically in FIG. 3, the security system 12 may further include a locking assembly 48 that cooperates either directly with the pressing components 30, or indirectly therewith through the actuating system 46. The aforementioned ratchet arrangement is part of both an actuating system and locking assembly.

Figure 4:
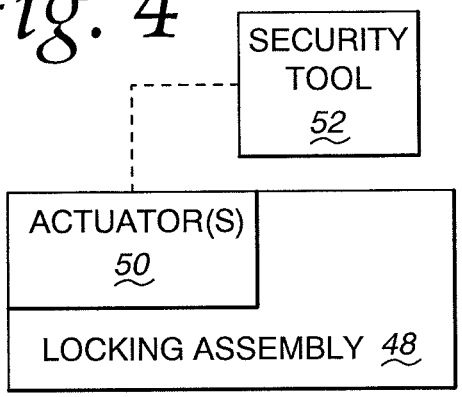
FIG. 4 is a schematic representation of a locking assembly that makes up part of the security system and a security tool for operating the same.

In FIG. 4, the locking assembly 48 is shown schematically with a generic type of actuator or actuators 50. The actuator (s) 50 may require a special security tool 52 to operate the same. The security tool 52 may have a special fitting, may incorporate a magnetic component, etc. to effect operation, such as locking and/or unlocking.

The basic function of the security system 12, as shown in FIG. 3, may be such that the wick 38 is blocked and/or the candle is aesthetically compromised. A would-be thief would be less inclined to take the candle knowing that it is not normally operable or that likely the security system 12 would have to be separated through a difficult or time consuming operation that might result in a breakage of the glass.

Figure 5:
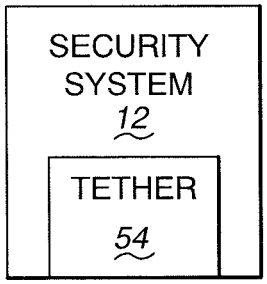
FIG. 5 is a schematic representation of the inventive security system incorporating a tether.

In an alternative form, shown in FIG. 5, the security system 12 may incorporate a tether 54 which allows connection to a support to confine movement of the container 10 within a certain range.

Figure 6:
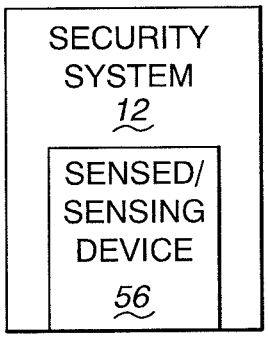
FIG. 6 is a schematic representation of the inventive security system incorporating a sensed/sensing device.

In a further alternative form, as shown in FIG. 6, the security system 12 may incorporate an electronically sensed, or electronic sensing, device 56. The device 56 may be configured to generate a sensory alert, as at a point-of-purchase location. A wide range of devices are currently available that operate electronically to detect or be detected within a certain proximity.

The disclosure to this point has been focused on the basic concepts without limitation as to specific form. Anticipated alternative forms and variations are numerous. For example, the depicted form of the security system 12 might be such that a single pressing component 30 moves to effect squeezing of a part of the security system 12 within the access opening 22 against the surface 20.

While a continuous shape around the axis 34 is shown for the friction component 28, one or more discrete friction components might be utilized as an alternative construction. Some level of conformance/conformability of the friction component 28 to the access opening surface 20 is desirable to produce an adequate frictional force.

The locking assembly 48, as mentioned above, does not have to be of any particular form. What is desirable is that it is selectively changeable between: a) a locked state wherein the security system 12 is maintained in the secured state; and b) an unlocked state wherein the security system 12 can be changed from the secured state into the assembly state.

Figure 8:
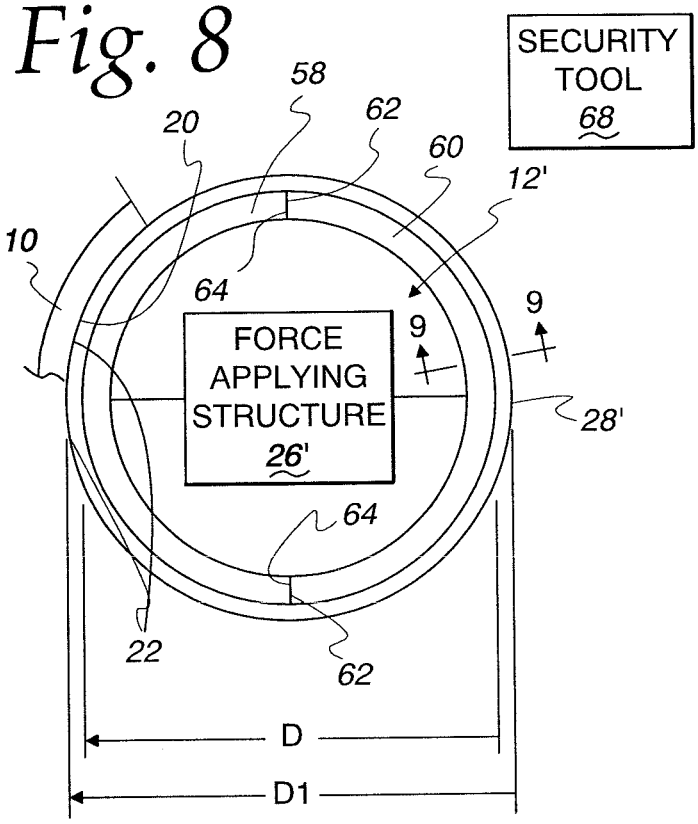
FIG. 8 is a plan view of another form of security system, according to the invention, in relationship to a portion of a container surface.
Figure 9:
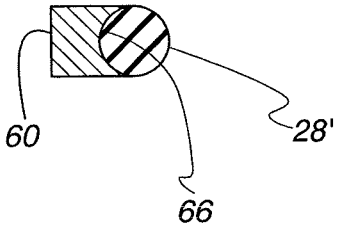
FIG. 9 is a cross-sectional view of the security system taken along line 9-9 of FIG. 8.

In FIGS. 8 and 9, a modified form of security system 12' is shown in operative relationship with a section of the container 10 and with the security system in the secured state in FIG. 8.

The security system 12' consists of separate body parts 58, 60 having the same or different construction. As depicted, the body parts 58, 60 have the same construction whereby with the ends 62 on the body part 58 abutted to the ends 64 on the body part 60, the body parts 58, 60 together define a generally circular shape with an outer perimeter that is nominally matched to the shape of the storage space surface 20. The effective diameter D of the abutted body parts 58, 60 is slightly less than the effective diameter of the access opening surface 20.

An elastic friction component 28' is placed in surrounding relationship with the abutted body parts 58, 60 and maintains the same in a generally circular shape. The friction component 28' is sized to fit in an annular, outwardly opening groove 66 defined cooperatively by the body parts 58, 60. The continuous shape of the friction component 28' maintains the body parts 58, 60 in the generally circular shape and projects slightly therebeyond to have an overall effective diameter D1 that is slightly greater than the diameter D. The friction component 28 is also sized so that it must be stretched to surround the body parts 58, 60 which are thus biasably urged towards each other through a restoring force in the stretched friction component 28.

The diameter D1 is also selected so that the security system 12' in the assembly state can be squeezed downwardly into the access opening 22 to align with the access opening surface 20. The friction component 28' is radially compressed as the security system 12' is pressed into place.

Through a suitably constructed force applying structure 26', the body parts 58, 60 can be moved away from each other to press the friction component 28' against the access opening surface 20 to positively maintain the security system 12' in its secured state. The force applying structure 26' may take virtually an unlimited number of different forms and is preferably one that requires a special security tool 68 to be reconfigured to allow the security system 12' to be changed from the secured state back into the assembly state.

Figure 10:
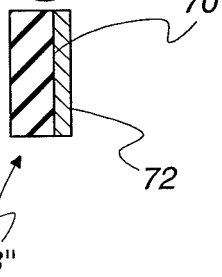
FIG. 10 is a cross-sectional view of a friction component, as shown schematically in FIG. 3, and modified to be adhered to a container surface.

With an alternative form of friction component, as shown at 28" in FIG. 10, an outwardly facing surface 70 thereon is adhered to the particular container surface with the associated security system in its secured state. As shown, an adhesive layer 72 is applied between the surface 70 and the container surface.

Other configurations of adhering structure are contemplated. Typically, the adhered surface would have to be drawn radially away from the container surface to effect separation. A relatively minimal pressure application on the adhered surface 70 towards the container surface will prohibit slippage as might allow the security system to be separated from the container.

Whatever component is adhered to the access opening surface or another container surface is preferably releasably adhered so that it can be separated from the container after the remaining portions of the security system are withdrawn.

In one form, a double-sided, pressure-sensitive adhesive may be interposed between the surface 70 and the container surface.

Figure 11:
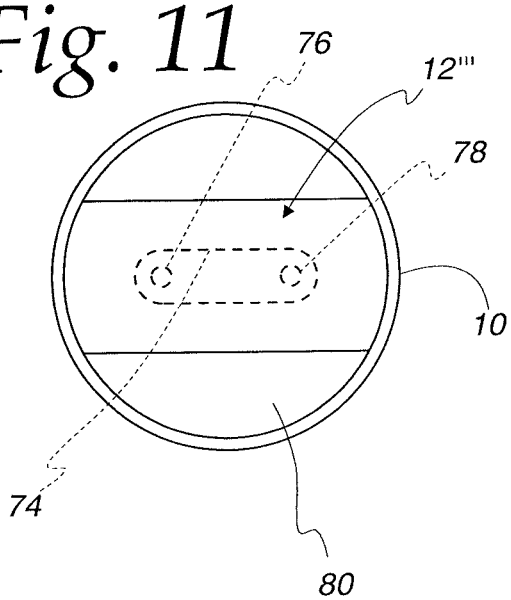
FIG. 11 is a plan view of a further modified form of security system in relationship to a container with a pair of wick lengths embedded in wax.

As shown in FIG. 11, a further modified form of security system 12' may incorporate one or more openings/cavities 74 to accept, in the depicted form, separate wick lengths 76, 78 projecting from a supply of wax 80 in a container, shown as the representative container 10. The security system 12' is configured so that the projecting portions of the wick lengths 76, 78 are not pressed against a wax material 80 with the security system 12' in the operative relationship with the container 10 and the security system 12' in the secured state.

A similar combination can be made for projecting wick lengths in excess of two.

Figure 12:
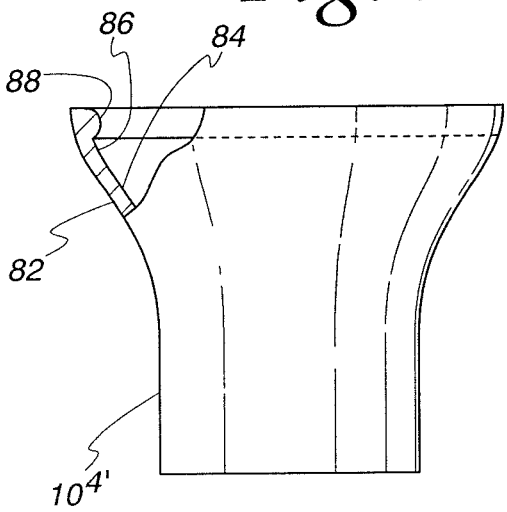
FIG. 12 is a view as in FIG. 7 and showing a further modified form of container with which the inventive security system can be utilized.

In FIG. 12, another alternative container shape is shown at 10$^{4'}$ with a tapering perimeter wall 82. The inventive concepts described above can be utilized to devise a security system that can be pressed controllably against an inside surface 84 of the wall 82 to maintain a security system 12 in the secured state.

Often, containers such as the container 10$^{4'}$ have an upper bead 86 that defines a ledge 88 that facilitates blocking of the particular friction component 28.

With all embodiments, as shown in FIG. 1, a cap 90 might be included to block the access opening 22 with the security system 12 in the operative relationship with the container 10 and the security system 12 in the secured state.

As also noted above, the product with which the security system 12 is used is not limited to a candle product. Nor is the shape of the container 10 limited to those described hereinabove.

Figure 7:
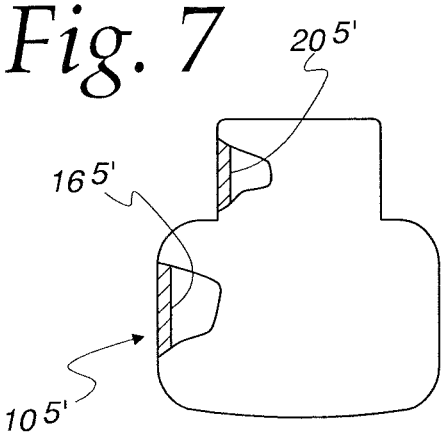
FIG. 7 is a partially broken away, elevation view showing an alternative form of container with which the inventive security system can be used.

For example, as shown in FIG. 7, the security system $\mathbf{12}^{5'}$ might be utilized with a container $\mathbf{10}^{5'}$ with a storage space surface $\mathbf{16}^{5'}$ that has a diameter greater than a surface $\mathbf{20}^{5'}$ on an access opening.

The foregoing disclosure of specific embodiments is intended to be illustrative of the broad concepts comprehended by the invention.

The invention claimed is:

1. In combination:

a) a container having a case bounding a storage space and an access opening bounded by a surface and in communication with the storage space; and b) a security system comprising:

a frame; and a force applying structure on the frame, the frame and force applying structure configured so that with the security system in operative relationship with the container, the security system can be placed selectively in: i) a secured state wherein the force applying structure exerts a compressive force against the access opening surface to thereby prevent at least a part of the security system from being withdrawn from the access opening; and ii) an assembly state wherein the at least part of the security system can be both directed into the access opening and withdrawn from the access opening without changing a shape of, or deforming, any portion of the at least part of the security system, wherein the container has a wax material therein with an embedded wick.

2. The combination according to claim 1 wherein the force applying structure comprises at least one friction component that is: a) pressed against the access opening surface with the security system in the operative relationship with the container and the security system in the secured state; and b) remains against the access opening surface with the security system changed to the assembly state and the frame and a portion of the force applying structure, together making up the at least part of the security system, separated from the container.

3. The combination according to claim 2 wherein the at least one friction component has a peripheral shape extending continuously around an axis.

4. The combination according to claim 2 wherein the access opening surface extends continuously around an axis and the at least one friction component has a peripheral shape that conforms to at least a part of the access opening surface.

5. The combination according to claim 2 wherein the at least one friction component is made from a compressible material.

6. The combination according to claim 1 wherein the access opening surface extends around an axis and the force applying structure comprises first and second pressing components that are each moved radially outwardly in a predetermined manner relative to the frame in different directions as the security system is changed from the assembly state into the secured state.

7. The combination according to claim 6 wherein the first and second components translate in different radial directions.

8. The combination according to claim 1 wherein the access opening surface extends around an axis, the storage space is bounded by a surface extending around the axis and a shape and size of the access opening surface and storage space surface are substantially the same as viewed along the axis.

9. The combination according to claim 1 wherein the container is made from glass.

10. In combination:

a) a container having a case bounding a storage space and an access opening bounded by a surface and in communication with the storage space, wherein the container has a wax material in the storage space with an embedded wick; and b) a security system comprising:

a frame; and a force applying structure on the frame, the frame and force applying structure configured so that with the security system in operative relationship with the container, the security system can be placed selectively in: i) a secured state wherein the force applying structure exerts a compressive force against the access opening surface to thereby prevent at least a part of the security system from being withdrawn from the access opening; and ii) an assembly state wherein the at least part of the security system can be directed into the access opening and withdrawn from the access opening, wherein the force applying structure comprises at least one friction component that is pressed against the access opening surface with the security system in the operative relationship with the container and the security system in the secured state, wherein the at least one friction component is separable from the at least part of the security system including the frame.

11. In combination:

a) a container having a case bounding a storage space and an access opening bounded by a surface and in communication with the storage space; and b) a security system comprising:

a frame; and a force applying structure on the frame, the frame and force applying structure configured so that with the security system in operative relationship with the container, the security system can be placed selectively in i) a secured state wherein the force applying structure exerts a compressive force against the access opening surface to thereby prevent at least a part of the security system from being withdrawn from the access opening; and ii) an assembly state wherein the at least part of the security system can be both directed into the access opening and withdrawn from the access opening without changing a shape of, or deforming, any portion of the at least part of the security system, wherein the security system further comprises a locking assembly that is configured to be selectively changed between: a) a locked state wherein the security system is prevented from being changed from the secured state into the assembly state; and b) an unlocked state wherein the security system can be changed from the secured state into the assembly state, further in combination with a special security tool configured to be usable to change the locking assembly from the locked state into the unlocked state.

12. In combination:

a) a container having a case bounding a storage space and an access opening bounded by a surface and in communication with the storage space; and b) a security system comprising:

a frame; and a force applying structure on the frame, the frame and force applying structure configured so that with the security system in operative relationship with the container, the security system can be placed selectively in: i) a secured state wherein the force applying structure exerts a compressive force against the access opening surface to thereby prevent at least a part of the security system from being withdrawn from the access opening; and ii) an assembly state wherein the at least part of the security system can be both directed into the access opening and withdrawn from the access opening without changing a shape of, or deforming, any portion of the at least part of the security system, wherein the force applying structure comprises at least one friction component that is: a) pressed against the access opening surface with the security system in the operative relationship with the container and the security system in the secured state; and b) remains against the access opening surface with the security system changed to the assembly state and the frame and a portion of the force applying structure, together making up the at least part of the security system, separated from the container, wherein the at least one friction component is adhered to the access opening surface.

13. The combination according to claim 12 wherein the at least one friction component is releasably adhered to the access opening surface.

14. In combination:

a) a container having a case bounding a storage space and an access opening bounded by a surface and in communication with the storage space; and b) a security system comprising:

a frame; and a force applying structure on the frame, the frame and force applying structure configured so that, with the security system in operative relationship with the container, the security system can be placed selectively in: i) a secured state wherein the force applying structure exerts a compressive force against the access opening surface to thereby prevent at least a part of the security system from being withdrawn from the access opening; and ii) an assembly state wherein the at least part of the security system can be both directed into the access opening and withdrawn from the access opening without changing a shape of, or deforming, any portion of the at least part of the security system, wherein the force applying structure comprises at least one friction component that is: a) pressed against the access opening surface with the security system in the operative relationship with the container and the security system in the secured state; and b) remains against the access opening surface with the security system changed to the assembly state and the frame and a portion of the force applying structure, together making, up the at least part of the security system, separated from the container, wherein an adhesive layer is applied between the at least one friction component and the access opening surface.

15. In combination:

a) a container having a case bounding a storage space and an access opening bounded by a surface and in communication with the storage space; and b) a security system comprising:

a frame; and a force applying structure on the frame, the frame and force applying structure configured so that with the security system in operative relationship with the container, the security system can be placed selectively in: i) a secured state wherein the force applying structure exerts a compressive force against the access opening surface to thereby prevent at least a part of the security system from being withdrawn from the access opening; and ii) an assembly state wherein the at least part of the security system can be directed into the access opening and withdrawn from the access opening, wherein the container has a wax material therein with a plurality of embedded wick lengths that project through the wax and the security system is configured so as not to press the plurality of embedded wick lengths against the wax material with the security system in the operative relationship with the container and the security system in the secured state.

16. In combination:

a) a container having a case bounding a storage space and an access opening bounded by a surface and in communication with the storage space; and b) a security system comprising:

a frame; and a force applying structure on the frame, the frame and force applying structure configured so that with the security system in operative relationship with the container, the security system can be placed selectively in: i) a secured state wherein the force applying structure exerts a compressive force against the access opening surface to thereby prevent at least a part of the security system from being withdrawn from the access opening; and ii) an assembly state wherein the at least part of the security system can be directed into the access opening and withdrawn from the access opening, wherein the container and security system is provided further in combination with a releasable cap that blocks the access opening with the security system in the operative relationship with the container and the security system in the secured state.

17. In combination:

a) a container having a case bounding a storage space and an access opening bounded by a surface and in communication with the storage space; and b) a security system comprising:

a frame; and a force applying structure on the frame, the frame and force applying structure configured so that with the security system in operative relationship with the container, the security system can be placed selectively in: i) a secured state wherein the force applying structure exerts a compressive force against the access opening surface to thereby prevent at least a part of the security system from being withdrawn from the access opening; and ii) an assembly state wherein the at least part of the security system can be directed into the access opening and withdrawn from the access opening, wherein the container has a wax material therein with an embedded wick, wherein with the security system in operative relationship with the container and in the secured state, the wax material remains directly exposed through the access opening.

* * * * *